US011261061B2

(12) United States Patent
Van Eijgen

(10) Patent No.: US 11,261,061 B2
(45) Date of Patent: Mar. 1, 2022

(54) STAIRLIFT

(71) Applicant: TK HOME SOLUTIONS B.V., Krimpen aan den Ijssel (NL)

(72) Inventor: Wilco Van Eijgen, Rijnsburg (NL)

(73) Assignee: TK HOME SOLUTIONS S.V., Krimpen aan den Ijssel (NL)

( * ) Notice: Subject to any disclaimer, the term of this patent is extended or adjusted under 35 U.S.C. 154(b) by 65 days.

(21) Appl. No.: 16/629,388

(22) PCT Filed: Jul. 10, 2018

(86) PCT No.: PCT/EP2018/068590
§ 371 (c)(1),
(2) Date: Jan. 8, 2020

(87) PCT Pub. No.: WO2019/011884
PCT Pub. Date: Jan. 17, 2019

(65) Prior Publication Data

US 2020/0172378 A1 Jun. 4, 2020

(30) Foreign Application Priority Data

Jul. 13, 2017 (DE) ..... 10 2017 212 019.3
Oct. 4, 2017 (EP) ..... 17194815

(51) Int. Cl.
*B66B 9/08* (2006.01)

(52) U.S. Cl.
CPC ..... *B66B 9/0853* (2013.01); *B66B 9/0807* (2013.01)

(58) Field of Classification Search
CPC ..... B66B 9/0853; B66B 9/0807
USPC ..... 187/201
See application file for complete search history.

(56) References Cited

U.S. PATENT DOCUMENTS

| | | | | |
|---|---|---|---|---|
| 2,888,099 | A | 5/1959 | Hoffmann | |
| 4,913,264 | A | 4/1990 | Voves | |
| 10,081,517 | B1 * | 9/2018 | Cheng | B66B 9/0853 |
| 2005/0224293 | A1 * | 10/2005 | Molnar | B66B 9/0807 187/200 |

(Continued)

FOREIGN PATENT DOCUMENTS

| | | | |
|---|---|---|---|
| CN | 103987646 | A | 8/2014 |
| CN | 104973488 | A | 10/2015 |

(Continued)

OTHER PUBLICATIONS

First Office Action in foreign Chinese counterpart patent application No. 201880046495.8, dated Nov. 24, 2020, listing the above identified references that have not yet been submitted in an IDS for this application.

(Continued)

*Primary Examiner* — Jeffrey Donels
(74) *Attorney, Agent, or Firm* — William J. Cassin

(57) ABSTRACT

A stairlift may include a rail and a drive unit having a chair and a carrier. The carrier may be adapted to drive along the rail, and the chair may be supported by the carrier. The chair may have a folding mechanism that comprises a base body fixed to the carrier, a seat body that is foldably fixed by way of a seat joint to the base body, a leg body that is foldably fixed to the seat body by way of a leg joint, and a footrest body that is foldably fixed to the leg body by way of a footrest joint.

14 Claims, 9 Drawing Sheets

(56) References Cited

U.S. PATENT DOCUMENTS

| | | | | |
|---|---|---|---|---|
| 2008/0203775 | A1* | 8/2008 | Caroen | B66B 9/08 297/30 |
| 2012/0261216 | A1 | 10/2012 | Hrenchir et al. | |
| 2014/0332320 | A1 | 11/2014 | Woodhams | |
| 2016/0075535 | A1* | 3/2016 | Ooms | A61G 5/128 297/344.14 |
| 2020/0231411 | A1* | 7/2020 | Foggio, Jr. | A47C 7/626 |

FOREIGN PATENT DOCUMENTS

| | | | |
|---|---|---|---|
| CN | 206244227 | U | 6/2017 |
| DE | 202012100417 | U | 3/2012 |
| EP | 1197465 | A | 4/2002 |
| EP | 1765711 | B | 3/2007 |
| GB | 778091 | A | 7/1957 |
| JP | H02127383 | A | 5/1990 |
| JP | H0812240 | A | 1/1996 |
| JP | 2005213011 | A | 8/2005 |
| WO | 2006001694 | A | 1/2006 |
| WO | 2013129923 | A | 9/2013 |
| WO | 2015052489 | A | 4/2015 |

OTHER PUBLICATIONS

English Translation of International Search Report issued in PCT/EP2018/068590, dated Oct. 9, 2018 (dated Oct. 16, 2018).

* cited by examiner a)

b)

STAIRLIFT

CROSS REFERENCE TO RELATED APPLICATIONS

This application is a U.S. National Stage Entry of International Patent Application Serial Number PCT/EP2018/068590, filed Jul. 10, 2018, which claims priority to European Patent Application No. EP 17194815.1, filed Oct. 4, 2017, and German Patent Application No. DE 10 2017 212 019.3, filed Jul. 13, 2017, the entire contents of which are incorporated herein by reference.

FIELD

The present disclosure generally relates to stairlifts.

BACKGROUND

WIPO Patent Publication No. WO 2013/129923 A1 discloses a stairlift with a chair. A drive unit travels along at least one guide rail. A leveling mechanism is provided to hold the chair always in a horizontal orientation, even if the inclination angle of the guide rail is changing along the path of travel. In particular the rail of such lifts has a curved shape, like shown in FIG. 3 of WIPO Patent Publication No. WO 2015/052489 A1.

When the stairlift is not in use, the chair takes up space. Thus a need exists for an improved stairlift.

DETAILED DESCRIPTION

Figure 1:
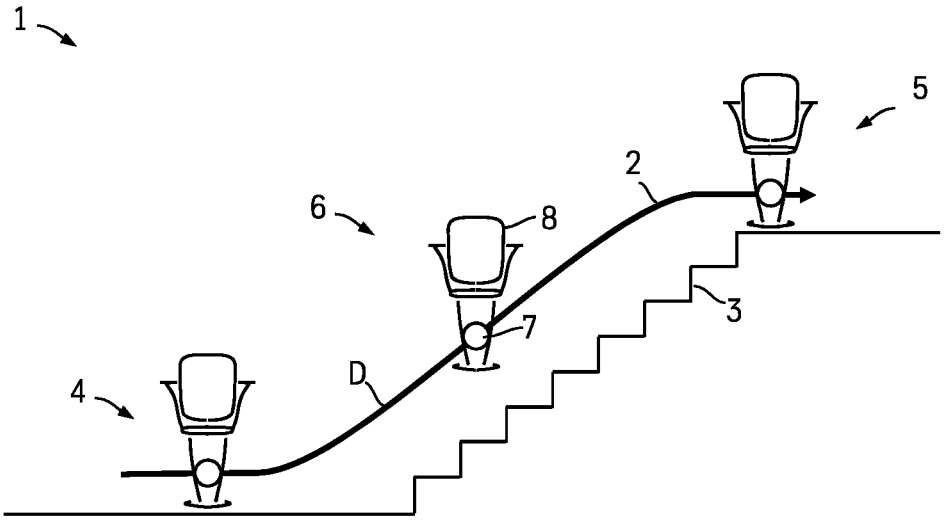
FIG. 1*a* is a front view of a generic platform lift.
FIG. 1*b* is a front view of a seat of the generic platform lift of FIG. 1*a*.
Figure 1:
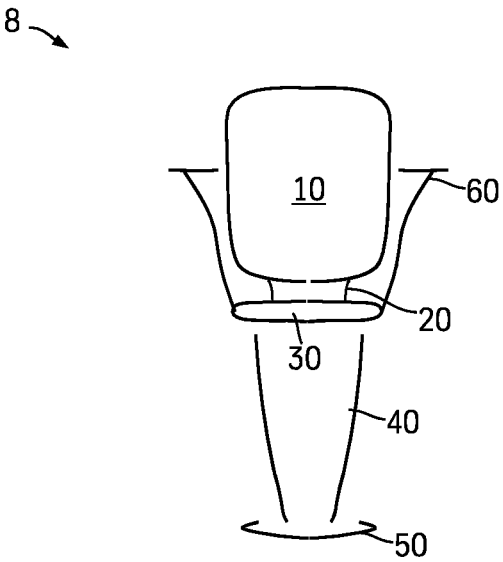

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The inventive stairlift comprises

- a rail,
- a drive unit having a chair and a carrier, wherein the carrier is adapted to drive along the rail, and the chair is supported by the carrier, the chair has a folding mechanism comprising

- a base body fixed to the carrier,
- a seat body, foldably fixed by means of a seat joint to the base body,
- a leg body, foldably fixed to the seat body by means of a leg joint,
- a footrest body, foldably fixed to the leg body by means of a footrest joint.

One advantage of the inventive stairlift lies in the opportunity to fold the chair, thus reducing the space occupied by the chair during a non-use period.

In some examples, measured from a center of a rail in side view the carrier has a first frontal extension, the chair has in its folded state a third frontal extension, wherein the folding mechanism is adapted so that the third frontal extension is not larger than the first frontal extension.

This improves the space efficiency during non-use.

In some examples, measured from a center of a rail in side view

- the chair has in its unfolded state a second frontal extension, and
- the folding mechanism is adapted so that during the folding process the overall frontal extension does not exceed the second frontal extension, in particular a path of folding of a most forward point of the chair does not exceed the second frontal extension.

This improves the space efficiency during the folding process. In particular, during folding/unfolding the footrest does not occupy more space in the frontal direction than in the unfolded position. Thus ensuring that during folding, the footrest does not hit any obstacles which it does not hit during normal operation.

In some examples, during the folding process of the chair the footrest body is automatically folded into its folded state. No additional action is necessary by the user to fold the footrest body.

In some examples during the unfolding process of the chair the footrest body is not automatically unfolded into its unfolded state, in particular, the folding mechanism comprising a footrest steering lever for selectively activating the unfolding process of the footrest body can be operated in either a manual or in an actuator driven manner.

Requiring a separate unfolding action by the user in the unfolding procedure, improves the ergonomics and the safety of the folding mechanism. In the opposite case the footrest would be unfolded automatically; but since the footrest is heavily protruding in the frontal direction, this could cause hurt to a user during unfolding. Therefore, it is preferred that the footrest is adapted to be unfolded upon a user action, i.e. pressing a button or shifting a lever.

In some examples the folding mechanism comprises a leg control lever arranged parallel to the seat body, in particular arranged between the base body and the leg body. The folding mechanism is adapted so that that during folding of the seat body (i.e. moving rearwards), this causes the footrest control lever to be pushed downwards causing the footrest body to also move rearwards.

The folding mechanism is adapted so that the longitudinal shifting of the leg control lever is initiated by a lifting of the seat body in the upward direction. Lifting can be done manually or induced by an actuator in particular a motor. Lifting can be supported by an actuator pushing the leg control lever particularly in the forward direction. A spring may be provided, counteracting any gravitational force of the chair components, and in particular save energy when driving an actuator.

In some examples the folding mechanism comprises a footrest control lever arranged parallel to the leg body, in particular arranged between the seat body and the footrest body. The folding mechanism is adapted so that during folding the footrest control lever is longitudinally shifted relative to the leg body, causing the footrest body to rotate in an upward direction.

In some examples during unfolding, in particular unfolding which is caused by an unlocked soft lock, the footrest body remains initially in a folded state during unfolding of the seat. The footrest may then be unfolded by a separate activation, either manually or electrically.

In some examples the longitudinal shifting of the footrest control lever is initiated by a rotation of the leg body in rearward direction. In particular a forward movement of the leg control lever is initiated relative to the seat body, causing the footrest control lever to move downward, which in turn initiates the footrest folding rearwards.

In some examples the folding mechanism comprises a knee lock mechanism, which is adapted to prevent the leg body from being folded when the chair, in particular the seat body, is in its unfolded position. In particular the knee lock mechanism is pushed into a locking position by the seat body. Without the knee lock mechanism, the leg control lever would be charged with a heavy torsional load; the lock may prevent this and thus increases stability and service life. The knee lock mechanism allows the leg control lever to be designed more compactly, thus improving the compact dimensions of the chair in the folded state.

In some examples the knee lock mechanism has a locking bar, which is can be shifted between a locking position and an unlocking position. In the locking position the locking bar is adapted to interact with a locking face attached to the leg body, thereby preventing rotation of the leg body, in particular relative to the seat body and/or the base body.

In some examples the folding mechanism comprises a footrest control lever arranged parallel to the leg body and connected to the base seat body and the footrest body, wherein the folding mechanism is adapted so that during folding the footrest control lever is longitudinally moved relative to the leg body, which causes the footrest body to rotate against the leg body. Same may apply during unfolding; however during unfolding there may be a different functionality as described later.

In some examples the folding mechanism comprises a footrest control lever lock for selectively establishing and releasing a rotational fixed connection between the footrest body and the seat body by the footrest control lever. In particular the footrest control lever lock is adapted so that a rotational fixed connection is established when the folding process is started, and/or the footrest control lever lock is adapted so that the rotational fixed connection is released when the unfolding process is started.

This feature describes a possibility to make sure that during unfolding the chair the footrest is not automatically unfolded as described above. The footrest control lever lock thereby may only provide an unfolding drive force to the footrest body when the lock is locked. In the unlocked state the footrest control lever is not able to turn the footrest body in its unfolded state.

In some examples, the footrest body is longitudinally adjustable, and in particular the footrest control lever is longitudinally adjustable. This provides a possibility to adjust the chair to the length of the person. A taller person may require a longer leg body than a shorter person. If an adjustable footrest body is provided, the footrest control lever needs also to be adjustable.

In particular the footrest control lever has a footrest upper control lever, a footrest lower control lever, a shift piece adapted to connect the footrest of the upper control lever with the footrest of the lower control lever at different longitudinal positions. This construction provides a possibility for establishing the adjustability in the longitudinal direction of the footrest upper control lever. In particular the shift piece is adapted to fulfill a softlock function.

FIGS. 1*a* and 1*b* show exemplary embodiments of a generic stairlift 1, to which the invention can be applied. The stairlift 1 comprises a drive unit 6 which travels along a direction of travel D from a first landing area 4 to a second landing area 5. The direction of travel D is defined by a rail 2 and is limited mainly by the course of an existing stairway 3 in a house. The drive unit 6 comprises a carrier 7, which serves for guiding the drive unit 6 at the rail and which has a drive engine (not shown). Attached to the carrier is a seat 8. The carrier 7 has non-shown rollers, which roll along the rail 2. For driving the carrier 7 positive engagements means (not shown) are provided on the rail 2, which cooperates with driving means, in particular a driven pinion (not shown), of the drive unit 6. The rail 2 has a curved shape, which deviates from a straight line; thus the direction of travel will change at least once during the course of the rail 2. A leveling mechanism is provided on the drive unit 6, to keep the chair 8 always in a horizontal orientation, even if the inclination of the rail 2 varies during its course.

The chair is described in more detail with reference to FIGS. 2 to 9. The chair 8 comprises a base body 20, which is attached to the carrier 7. Attached to the base body 20 is a backrest body 10 and a seat body 30. On the seat body 30 the user is sitting during travel. Therefore the seat body 30 may be equipped with a suitable cushion.

The seat body 30 is foldable along a seat axis S fixed to the base body 20 by a seat joint 31. The seat joint 31 is located at a rearward section of the seat body 30.

The chair comprises a footrest body 50, on which during travel a user can rest his feet on. For attaching the footrest body 50 at the rest of the chair 8 a leg body 40 is provided attaching the footrest body 50 to the seat body 30. The leg body 40 is foldable along a leg axis L fixed to the seat body 30 by a leg joint 41. The leg joint 41 is located at an upper section of the leg body 40 and at a forward section of the seat body 30.

The footrest body 50 is foldable along a footrest axis F fixed to the leg body 40 by a footrest joint 51. The footrest joint 51 is located at a lower section of the leg body 40 and at a rearward section of the footrest body 50.

Figure 2:
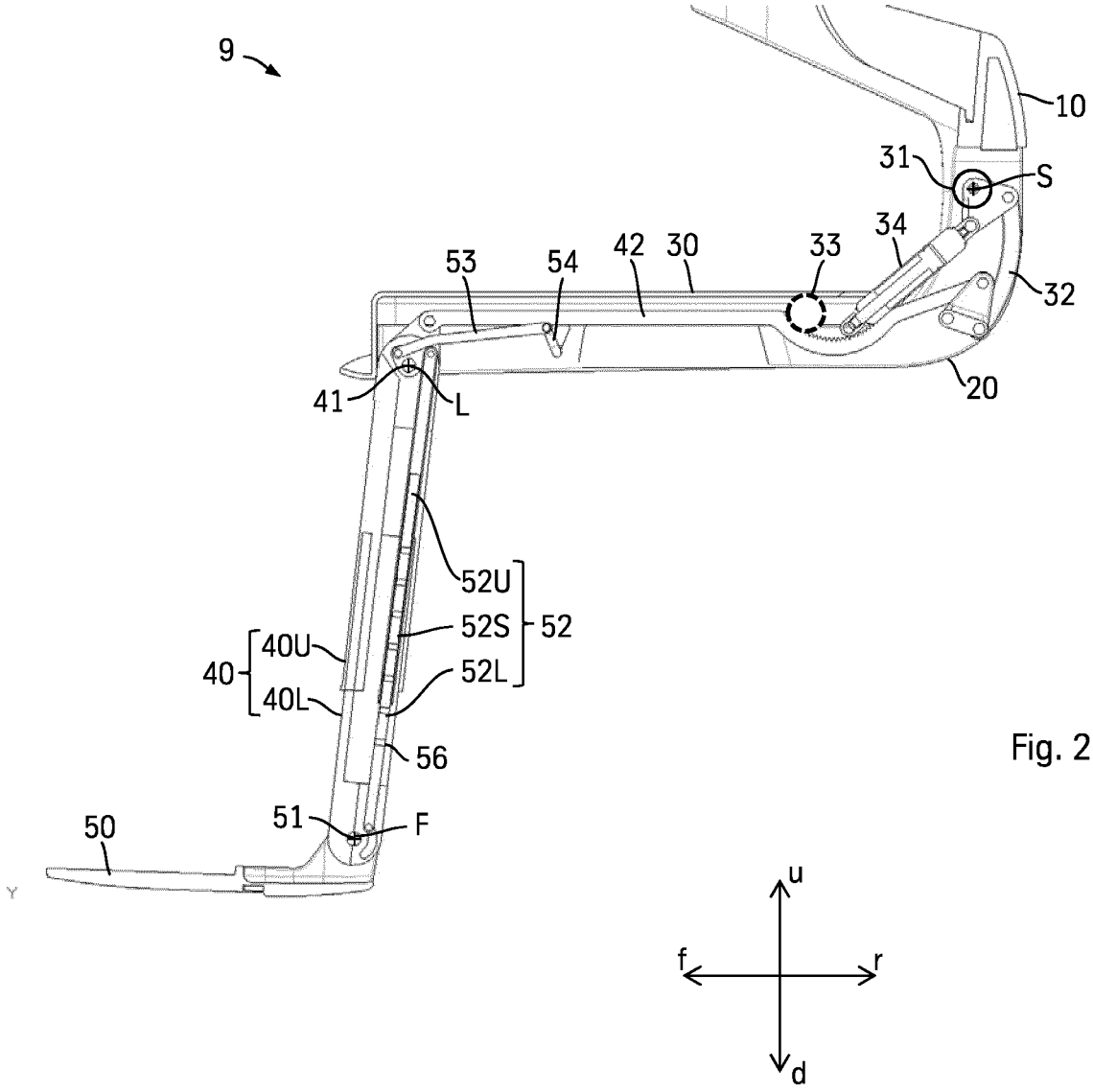
FIG. 2 is a side view of an example folding mechanism of an example stairlift in a first position.

The terms rearward, forward, upward, downward are relative to a user's point of view when sitting on the unfolded chair. The corresponding directions "rearward direction r", "forward direction f", "upward direction u" and "downward direction d" are shown in FIG. 2. As especially can be seen with reference to the leg body 40 these directions indicate rather an approximate direction than an exact orthogonal direction.

For causing the folding of the respective bodies 30, 40, 50 several control levers 32, 42, 52 are provided. Further an actuator 33 and a gas spring 34 is provided.

The gas spring 34 is attached to the base body 20 and at a rearward section of the seat body 30. The gas spring 34 is adapted to provide a push force between its attachment points at the base body 20 and at the seat body 30. The gas spring 34 is arranged to press on the seat body 30 when in the folded state. The gas spring 34 is not strong enough by itself to fold the seat from the unfolded into folded state. Thus, the seat is kept unfolded while in the unfolded state (FIG. 2). After a slight lifting of the seat body 30 the force of the gas spring 34 and the weight of the seat components overcome an equilibrium situation. Then the force of the gas spring 34 suffices to press the seat body 30 first in a forward direction f (see FIG. 3) and second in an upward direction d (see FIG. 4), resulting in a clockwise rotation according to the illustration of FIGS. 2 to 4.

Lifting of the seat body 30 can be initiated manually. Once the user lifts the seat body 30 manually until the equilibrium situation is reached, the gas spring 34 pushes the seat body 30 further upwards into the folded state (see FIGS. 4 and 5). Optionally the lifting of the seat body 30 is (with or without gas spring 34) supported by an actuator, in particular a motor 33. The function of the actuator 33 is described later.

Located primarily parallel to the seat body 30 is a leg control lever 42. The leg control lever 42 is rotatably attached to a seat control lever 32 (attached at the base body 20) and to an upward section of the leg body 40. The leg control lever 42 is attached to the leg body 40 above the leg joint 41. So, upon lifting of the seat body 30 the leg control lever 42 is pushed in a forward direction (arrow P1 in FIG. 3), thereby causing a rearward rotation of the leg body 40 relative to the seat body 30 (arrow P2 in FIG. 3). However, the leg body 40 remains in a vertical orientation over the entire folding process.

Located primarily parallel to the leg body 40 is a footrest control lever 52. The footrest control lever 52 cooperates with a footrest steering lever 53 and is further attached to a rearward section of the footrest body 50, the footrest steering lever 53 is connected to footrest control lever 52 via footrest control bracket 511. The footrest control lever 52 is attached to the footrest body 50, rearward to the footrest joint 51. When folding the leg body 40 rearward (arrow P2 in FIG. 3), the footrest control lever 52 is pushed in a downward direction d (arrow P3 in FIG. 3) relative to the leg body 40, thereby causing a rearward/upward rotation of the footrest body 50 relative to the leg body 40 (arrow P7 in FIG. 3).

Particularly in this embodiment the footrest steering lever 53, which is located at the seat body 30, is kept in place relative to seat body 30 during folding. Consequently the footrest control bracket 511 is not rotated relative to the seat body 30 during folding. Consequently the footrest control bracket 511 is rotated relative to the leg body 40, thus pushing the footrest control lever 52 downwards d (see arrow P3 in FIG. 3) relative to the leg body 40.

Figure 4:
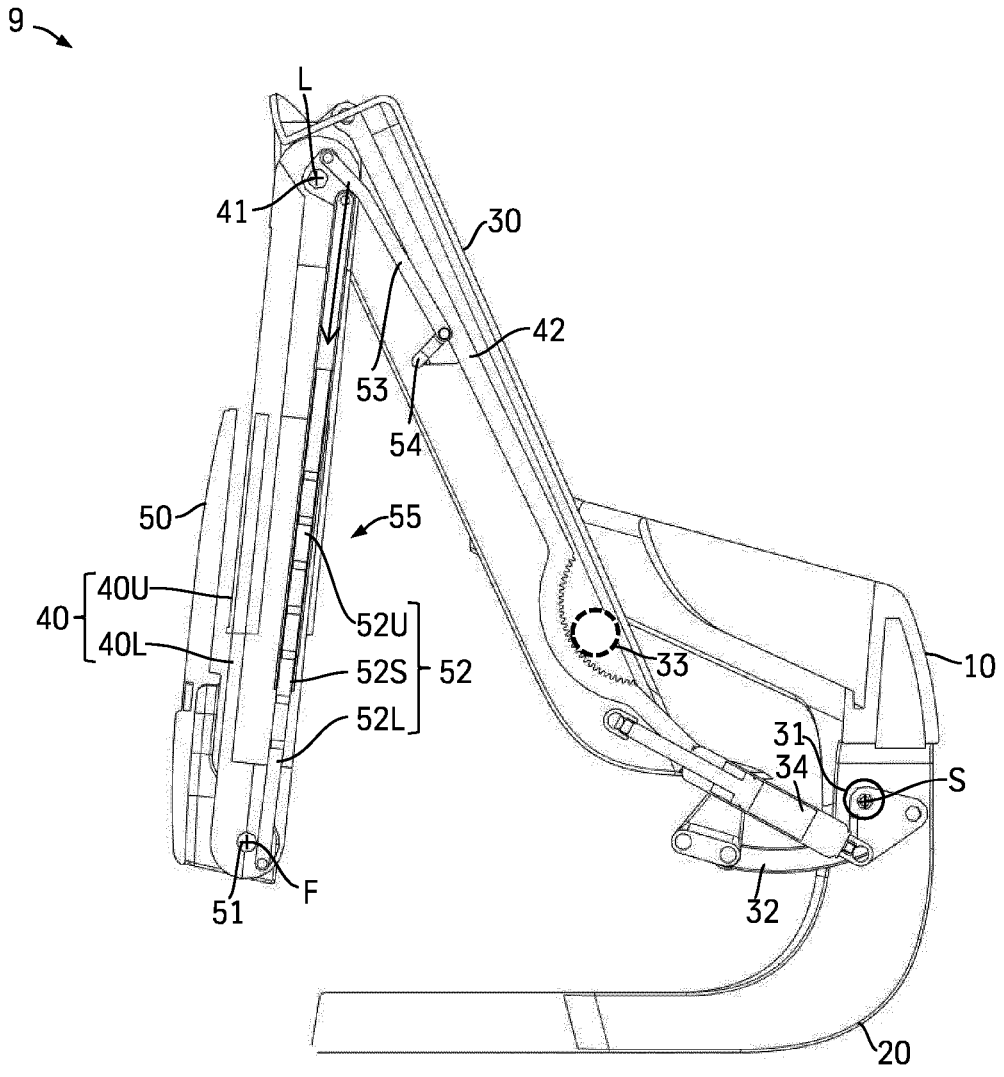
FIG. 4 is a side view of the folding mechanism of the example stairlift in a third position.

Due to the geometrical conditions, the footrest body 50 is folded into a vertical orientation already before the seat body 30 has reached its final vertical orientation (see FIG. 4). The folding of the footrest body 50 may be supported by a footrest supporting spring 510, which is shown later in FIG. 8. The footrest supporting spring 510 is attached on the lower section of the leg body 40, in particular to the leg lower body 40L. So the footrest supporting spring 510 always tries to push the footrest control lever 52 downwards d, counteracting against the gravity force of the footrest body 50.

The optional actuator 33 is attached at the seat body 30 and cooperates with the leg control lever 42, which is partially toothed for interacting with a gearwheel of the actuator 33. In an alternative embodiment the actuator 33 may be a linear actuator. Upon activating the actuator 33 the motor pushes the leg control lever 42 in the forward direction f, which in turn results in pushing force of the seat body 30 in forward direction f. As described some paragraphs earlier, this forward movement of the seat body in turn initiates the gas spring to overcome the equilibrium situation, thus supporting the seat body 30 when folding upwards.

Consequently, all steps during folding can be seen in FIGS. 2 to 5.

To support users of different size the leg body 40 is adapted to be adjustable in its length. Therefore the leg body 40 has an leg upper body 40U and a leg lower body 40L. The leg upper body 40U and the leg lower body 40L are connected to each other by a non shown snap lock device, which provides a fixation between the leg upper body 40U and the leg lower body 40L at discrete positions.

Figure 8:
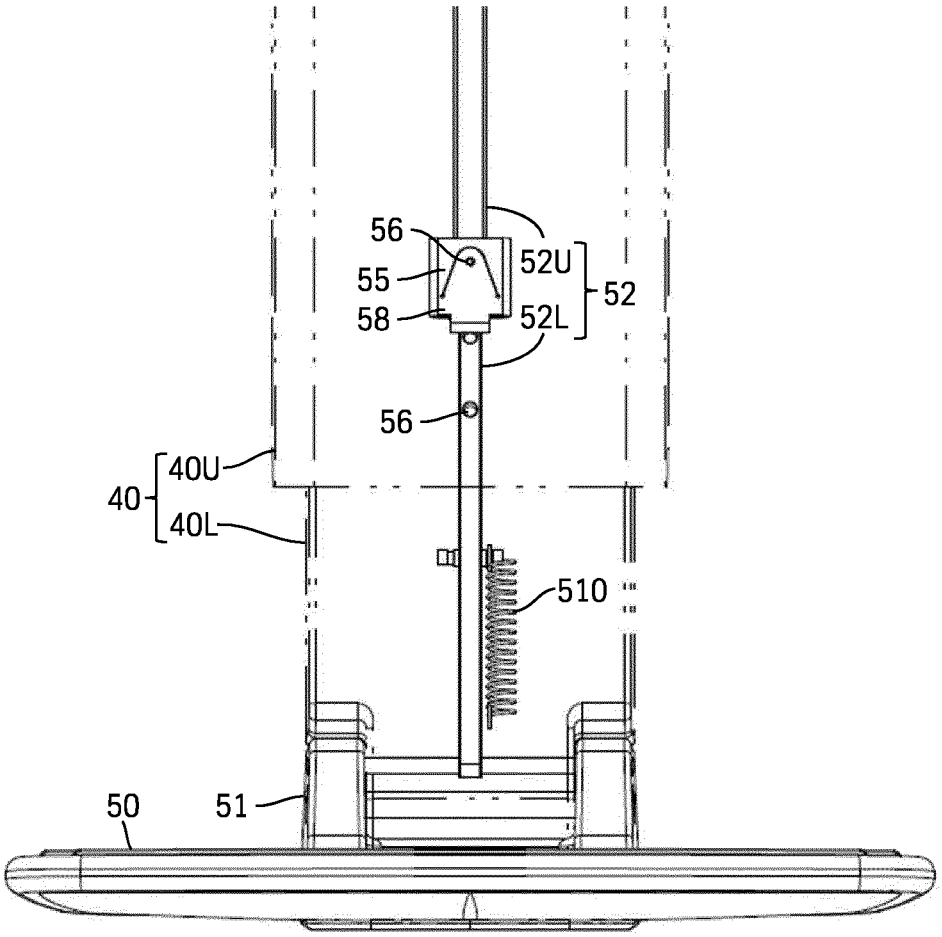
FIG. 8 is a detailed front view of a leg and footrest section of the example stairlift.

Corresponding thereto, the footrest control lever 52 is adjustable in its length, as shown in detail in FIG. 8. Therefore the footrest control lever 52 has a footrest upper control lever 52U and a footrest lower control lever 52L. Both lever 52U, 52L are connected to each other at a shift piece 52S (see FIG. 6) comprising a footrest control lever lock mechanism 55, in the following the s "softlock". In this example the softlock 55 comprises a softlock bracket 58 fixed to the footrest upper control lever 52U. The softlock bracket 58 provides a resilient support for a spring loaded softlock pin 56, which can engage selectively into one of several holes 56, arranged along the length of the footrest lower control lever 52L.

The softlock 55 is adapted to provide a well defined locking force. As long as the downward acting pushing force transmitted by the footrest control lever 52 is below a predefined level, the softlock 55 provides a fixed connection between the footrest upper control lever 52U and the footrest lower control lever 52L (softlock 55 is locked). As soon as the pushing force transmitted by the footrest control lever 52 is above a predefined level, the softlock pin 56 is pushed out of the respective hole 56 and the fixed connection is released (softlock 55 is unlocked). Then the footrest upper control lever 52U and the footrest lower control lever 52L can be shifted laterally free relative to each other until the pin 56 engages the previously engaged hole or another hole.

This mechanism is also used during adjusting the overall length of the leg body 40. During changing the length of the leg body, the leg upper body and the leg lower body are telescoped by applying a push or pull force. This push or pull force is also acting on the soft lock, thereby causing, under certain circumstances, the softlock to unlock. The length of the footrest control lever 52 is then adjusted according to the length adjustment of the leg body 40. As soon as the leg body 40 reaches one of the predetermined discrete length positions, then the softlock pin 56 is in an overlapping condition with another hole 56. Therefore distance of the discrete length position of the leg body 40 corresponds to the distance of the holes 56 at the leg control lever 52.

Figure 3:
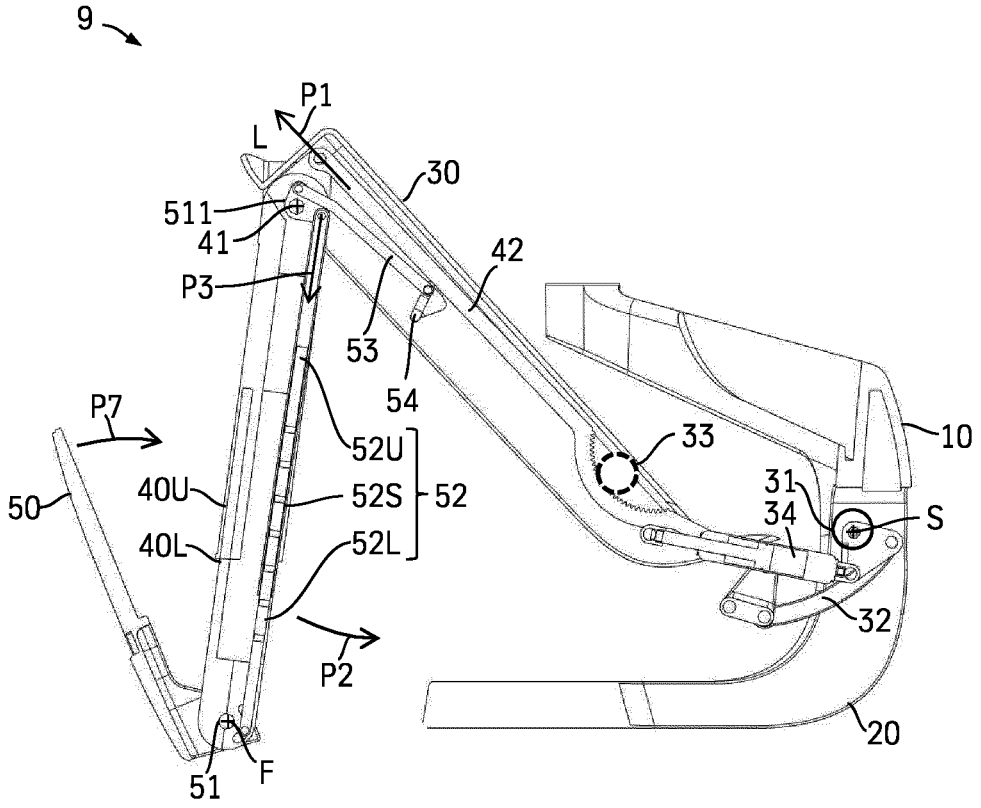
FIG. 3 is a side view of the folding mechanism of the example stairlift in a second position.
Figure 5:
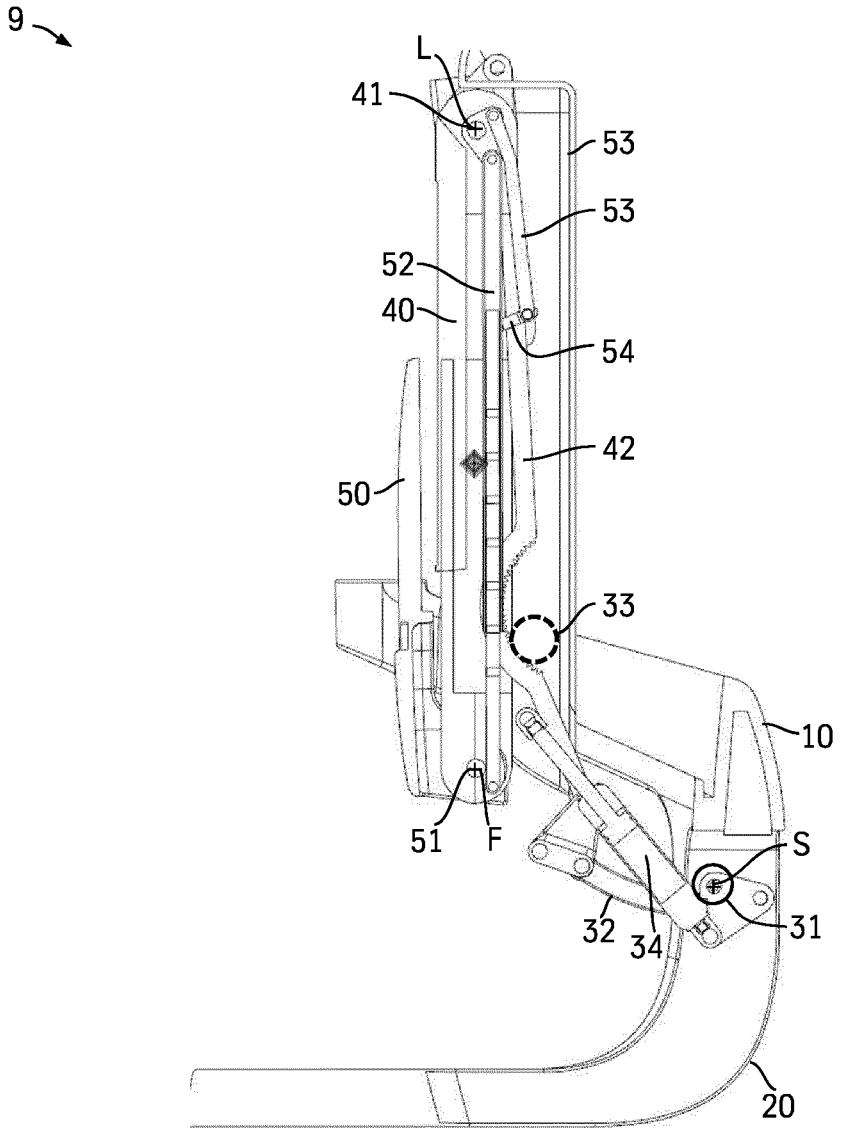
FIG. 5 is a side view of the folding mechanism of the example stairlift in a fourth position.

The softlock 55 is also utilized during the folding process. In FIGS. 2 and 3, when the folding process is started, the softlock 55 is locked. In FIG. 3 the pushing force is transmitted via the leg control lever 53 in the direction shown by arrow P3, to fold the footrest upwards u. Here the push force does not exceed the level of the softlock 55 or any part attached to the seat body 30. In FIG. 4 the footrest body 50 is completely folded. However the overall folding process is not completely finished. The footrest steering lever 53 is still pushing the footrest control lever downwards d. But since the footrest body 50 can not be folded any further, the pushing force increases until it reaches the limit defined by the softlock 55. Now the softlock 55 unlocks and the footrest upper control lever 52U is pushed downwards, without pushing the footrest lower control lever 52L downwards (FIGS. 4 and 5).

Figure 6:
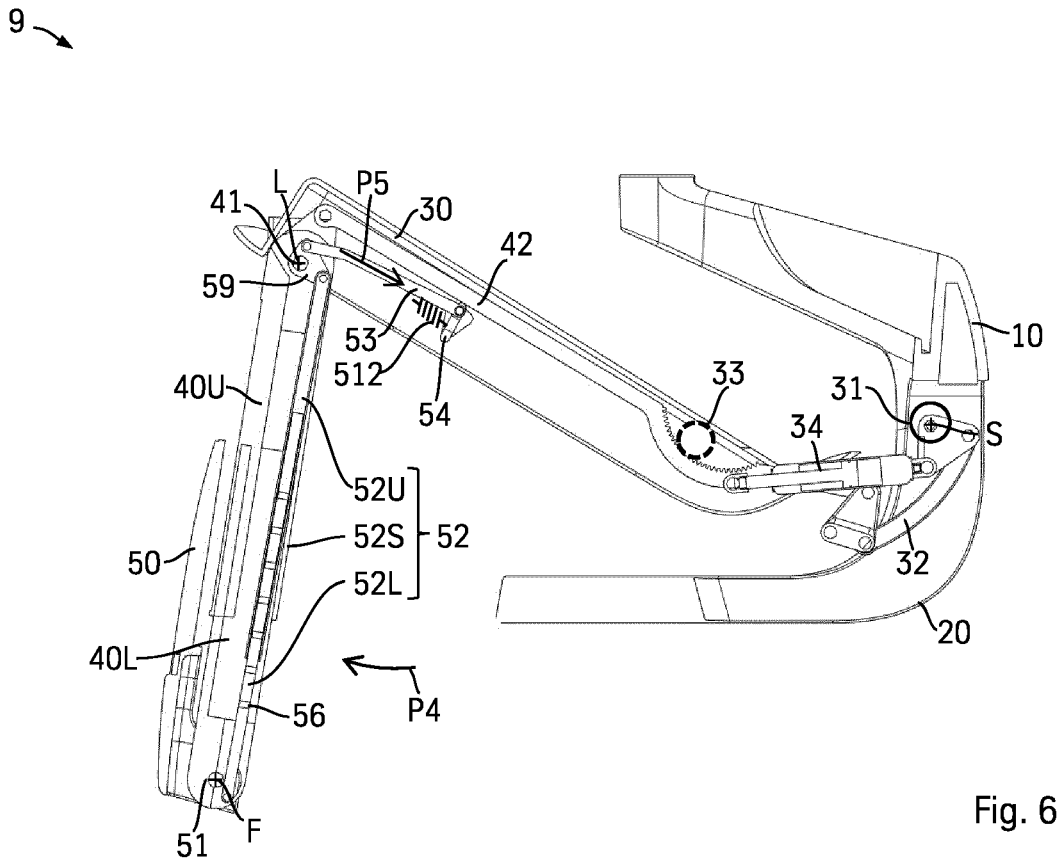
FIG. 6 is a side view of the folding mechanism of the example stairlift in a fifth position.
Figure 7:
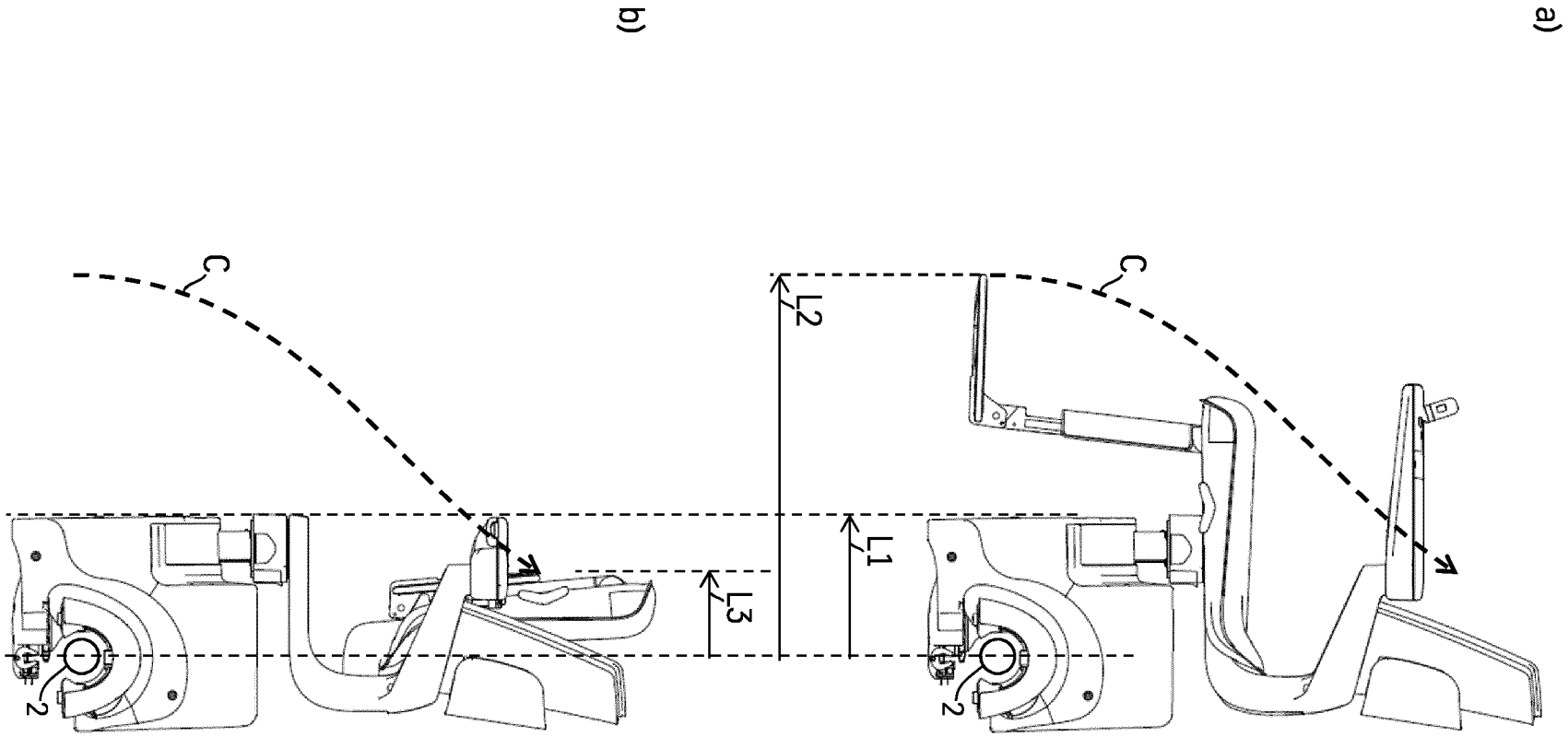
FIG. 7*a* is a side view of the stairlift with the chair unfolded.
FIG. 7*b* is a side view of the stairlift with the chair folded.

During unfolding, the softlock 55 is still unlocked. So when the seat body 30 and the leg body 40 start turning into their unfolded position (FIG. 6) the footrest control lever 52 has a reduced length compared to the unfolded status in FIG. 2. As the leg body 40 now turns in a forward direction (see arrow P4 in FIG. 6) the footrest control lever 52 is stretched. Here the footrest supporting spring 510 pulls the footrest lower control lever 52L downwards d and at the same time the steering bracket 59 pulls the footrest upper control lever 52U upwards, until the softlock locks in the initial position as in FIG. 2. A centering spring 512 (shown schematically in FIG. 6) urges the footrest steering handle and the footrest steering lever in a neutral position (arrow P5 in FIG. 6), causing the footrest body 50 to maintain its folded position as shown in FIG. 6. As soon as the footrest steering handle 54 is pushed forward f by a user, this pushes the footrest steering lever 53 forward f, the steering bracket 59 anti-clockwise, and the footrest control lever 52 (locked state) downwards d, thus resulting in a unfolding the footrest body 50.

Figure 9:
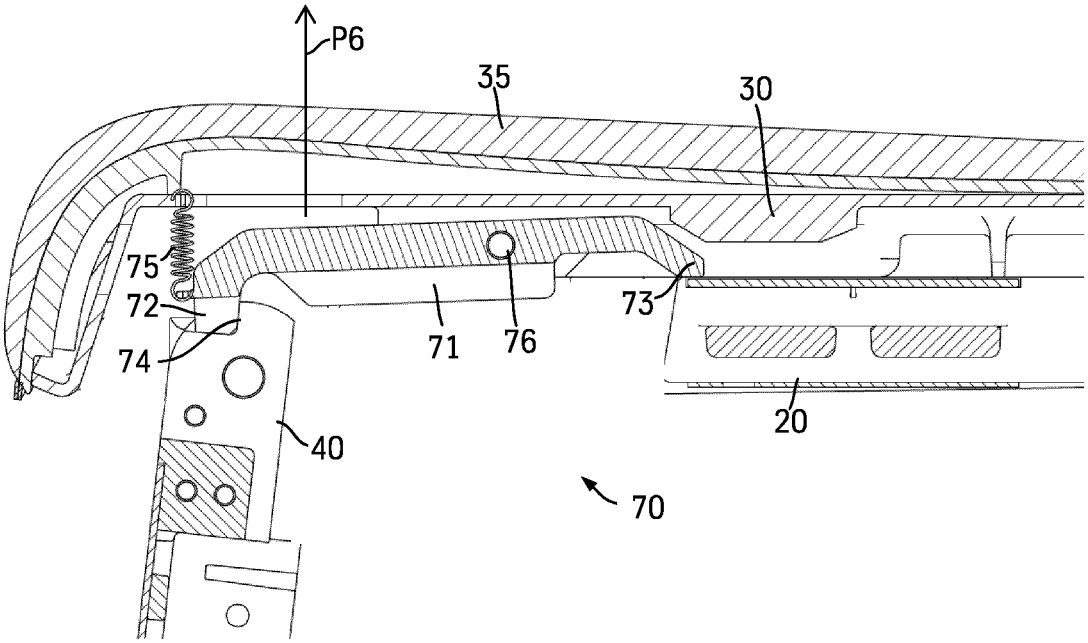
FIG. 9 is a cross-sectional side view of a seat and leg section of the example stairlift comprising a knee lock mechanism.
Figure 10:
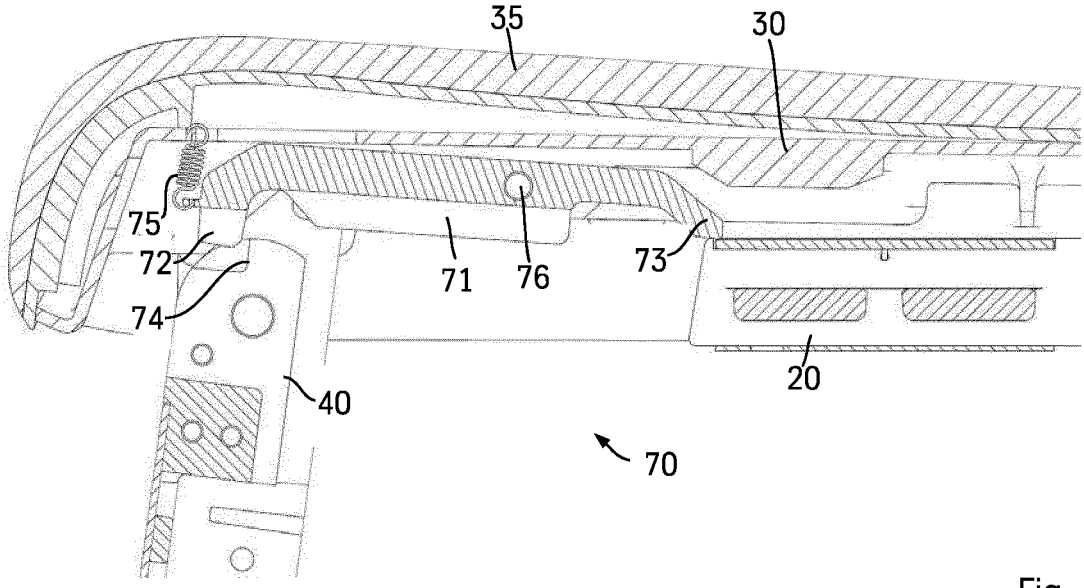
FIG. 10 is a cross-sectional side view of the example stairlift with a locking bar that has been lifted.

FIGS. 9 and 10 shows a knee lock mechanism 70 which prevents the leg bar from being folded, when the chair is unfolded. The knee lock mechanism 70 comprises a locking bar 71, which is adapted to interact with a locking face 74 attached at the leg body 40. When a first end 72 of the locking bar 71 abuts the locking face 74, the leg body 40 is prevented from being rotated against the seat body 30 and the base body 20 (locking position shown in FIG. 9).

The locking bar 71 is pivotably supported by a locking bar joint 76. In this example the locking bar joint 76 is attached to the seat body 30 interfacing with the base body 20 and the leg body 40. A second end 73 of the locking bar 71 abuts in the locking position against the base body 20. When the seat body 30 is in the unfolded position, the seat base 30 pushes the locking bar 71 against the base body 20, causing the first end 72 to be pushed down against the locking face 74.

During folding the chair 9, the seat body 30 is lifted upwards u. Now the seat body 30 pulls the locking bar 71 upwards away from the leg body 40 (see arrow P6 in FIG. 9, when the bar is not lifted yet), causing also the locking bar 71 to release form the locking face 74 (FIG. 10, showing the lifted locking bar). Pulling the locking bar 71 is support by an extension spring 75 arranged between the seat body and the first end 72. As soon as the seat body is slightly lifted the extension spring 75 causes the locking bar 71 to turn away from the locking face 74. During locking the extension spring 75 keeps the first end 72 turned away from the locking face 74. Only during the last phase of the chair unfolding does the base body 20 contact the locking bar 71 at the locking bar second end 73. This causes the first end 72 to turn against the locking face 74 not before the last phase of the unfolding phase. This improves the smooth locking procedure.

When the locking bar 71 is in its locked position, the leg body 30 cannot rotate against the seat body 30. So the leg control lever 42 is discharged from any tensile load acting on the leg body 40 and the base body 20. Heavy loads may apply for example, if a person is standing on the footrest body 50.

LIST OR REFERENCE SIGNS

1 stairlift
2 rail
3 stairs
4 first landing area
5 second landing area
6 drive unit
7 carrier
8 chair
9 folding mechanism
10 backrest body
20 base body
30 seat body
31 seat joint
32 seat control lever
33 actuator
34 gas spring
35 cushion
40 leg body (connecting footrest body with seat body)
40U leg upper body
40L leg lower body
41 leg joint
42 leg control lever
50 footrest body
51 footrest joint
52 footrest control lever
52U footrest upper control lever
52L footrest lower control lever
52S shift piece
53 footrest steering lever
54 footrest steering handle
55 footrest control lever lock mechanism/softlock
56 holes
57 blocking pin
58 softlock bracket
59 steering bracket
510 footrest supporting spring
511 footrest control bracket
512 centering spring
60 armrest body
70 knee lock mechanism
71 locking bar
72 locking bar first end
73 locking bar second end
74 locking face
75 extension spring
76 locking bar joint
D path of travel
S seat axis
L leg axis
F footrest axis
C "Curve of footrest" during folding process

The invention claimed is:

1. A stairlift comprising:

a rail; and a drive unit having a carrier configured to drive along the rail, and a chair supported by the carrier, the chair including a folding mechanism that comprises:

a base body fixed to the carrier, a seat body foldably fixed by way of a seat joint to the base body, a leg body foldably fixed to the seat body by way of a leg joint, and a footrest body foldably fixed to the leg body by way of a footrest joint, wherein as measured from a center of the rail in a side view the carrier has a first frontal extension and the chair in a folded state has a third frontal extension, wherein the folding mechanism is configured so that the third frontal extension is equal to or smaller than the first frontal extension.

2. A stairlift comprising:

a rail; and a drive unit having a carrier configured to drive along the rail, and a chair supported by the carrier, the chair including a folding mechanism that comprises:

a base body fixed to the carrier, a seat body foldably fixed by way of a seat joint to the base body, a leg body foldably fixed to the seat body by way of a leg joint, and a footrest body foldably fixed to the leg body by way of a footrest joint, wherein, as measured from a center of the rail in a side view, the chair has in an unfolded state a second frontal extension, and the folding mechanism is configured so that during folding an overall frontal extension is equal to or less than a second frontal extension such that a path of folding of a most-forward point of the chair is equal to or less than the second frontal extension.

3. The stairlift of claim 1, wherein the folding mechanism is configured to automatically fold the footrest body into a folded state during the folding.

4. The stairlift of claim 3, wherein the folding mechanism is configured so that during unfolding the footrest body is prevented from automatically unfolding into an unfolded state, wherein the folding mechanism comprises a footrest steering lever for selectively activating unfolding of the footrest body, the footrest body being configured to be operated in either a manual manner or an actuator-driven manner.

5. A stairlift comprising:

a rail; and a drive unit having a carrier configured to drive along the rail, and a chair supported by the carrier, the chair including a folding mechanism that comprises:

a base body fixed to the carrier, a seat body foldably fixed by way of a seat joint to the base body, a leg body foldably fixed to the seat body by way of a leg joint, a footrest body foldably fixed to the leg body by way of a footrest joint, and a leg control lever disposed parallel to the seat body, wherein the leg control lever is disposed between the base body and the leg body, wherein the folding mechanism is configured such that, during folding, the leg control lever is longitudinally shifted relative to the seat body causing the leg body to rotate in a rearward direction.

6. The stairlift of claim 5 wherein the folding mechanism is configured such that longitudinal shifting of the leg control lever is initiated either manually by manual lifting of the seat body in an upward direction, or by an actuator pushing the leg control lever.

7. A stairlift comprising:

a rail; and a drive unit having a carrier configured to drive along the rail, and a chair supported by the carrier, the chair including a folding mechanism that comprises:

a base body fixed to the carrier, a seat body foldably fixed by way of a seat joint to the base body, a leg body foldably fixed to the seat body by way of a leg joint, a footrest body foldably fixed to the leg body by way of a footrest joint, and a footrest control lever disposed parallel to the leg body, between the seat body and the footrest body, wherein the folding mechanism is configured such that, during folding, the footrest control lever is longitudinally shifted relative to the leg body, causing the footrest body to rotate in an upward direction.

8. The stairlift of claim 7 wherein the folding mechanism is adapted such that during folding of the seat body rearwards, rotation of the seat body causes the footrest control lever to be pushed downwards, causing the footrest body to rotate rearwards.

9. A stairlift comprising:

a rail; and a drive unit having a carrier configured to drive along the rail, and a chair supported by the carrier, the chair including a folding mechanism that comprises:

a base body fixed to the carrier, a seat body foldably fixed by way of a seat joint to the base body, a leg body foldably fixed to the seat body by way of a leg joint, a footrest body foldably fixed to the leg body by way of a footrest joint, and a knee lock mechanism that is adapted configured to prevent the leg body from being folded while the seat body is in an unfolded position.

10. The stairlift of claim 9, wherein the knee lock mechanism includes a locking bar that is shiftable between a locking position and an unlocking position, wherein in the locking position the locking bar is configured to interact with a locking face attached to the leg body to prevent rotation of the leg body.

11. A stairlift comprising:

a rail; and a drive unit having a carrier configured to drive along the rail, and a chair supported by the carrier, the chair including a folding mechanism that comprises:

a base body fixed to the carrier, a seat body foldably fixed by way of a seat joint to the base body, a leg body foldably fixed to the seat body by way of a leg joint, a footrest body foldably fixed to the leg body by way of a footrest joint, and a footrest control lever disposed parallel to the leg body and connected to the seat body and the footrest body, wherein the folding mechanism is configured such that, during folding, the footrest control lever is longitudinally moved relative to the leg body, causing the footrest body to rotate against the leg body.

12. A stairlift comprising:

a rail; and a drive unit having a carrier configured to drive along the rail, and a chair supported by the carrier, the chair including a folding mechanism that comprises:

a base body fixed to the carrier, a seat body foldably fixed by way of a seat joint to the base body, a leg body foldably fixed to the seat body by way of a leg joint, a footrest body foldably fixed to the leg body by way of a footrest joint, and a footrest control lever lock mechanism for selectively establishing and releasing a rotational fixed connection between the footrest body and the seat body by a footrest control lever, wherein at least one of:

the footrest control lever lock mechanism is configured so that the rotational fixed connection is established when folding starts, or the footrest control lever lock mechanism is configured so that the rotational fixed connection is released when unfolding starts.

13. A stairlift comprising:

a rail; and a drive unit having a carrier configured to drive along the rail, and a chair supported by the carrier, the chair including a folding mechanism that comprises:

a base body fixed to the carrier, a seat body foldably fixed by way of a seat joint to the base body, a leg body foldably fixed to the seat body by way of a leg joint, a longitudinally adjustable footrest body that is foldably fixed to the leg body by way of a footrest joint, and a longitudinally adjustable footrest control lever.

14. The stairlift of claim 1, further comprising a footrest control lever that comprises:

a footrest upper control lever;

a footrest lower control lever; and a shift piece configured to connect the footrest upper control lever with the footrest lower control lever at different longitudinal positions.

* * * * *